US009445682B2

(12) United States Patent
Disney

(10) Patent No.: US 9,445,682 B2
(45) Date of Patent: Sep. 20, 2016

(54) ADJUSTABLE MOUNTING BRACKET FOR MOUNTING A MAILBOX

(71) Applicant: Chase Disney, Lenoir City, TN (US)

(72) Inventor: Chase Disney, Lenoir City, TN (US)

( * ) Notice: Subject to any disclaimer, the term of this patent is extended or adjusted under 35 U.S.C. 154(b) by 0 days.

(21) Appl. No.: 14/313,634

(22) Filed: Jun. 24, 2014

(65) Prior Publication Data

US 2014/0374473 A1 Dec. 25, 2014

Related U.S. Application Data

(60) Provisional application No. 61/838,929, filed on Jun. 25, 2013.

(51) Int. Cl.
*A47G 29/122* (2006.01)

(52) U.S. Cl.
CPC ..... *A47G 29/1216* (2013.01)

(58) Field of Classification Search
CPC .. A47G 29/1216; F16M 11/04; F16M 13/02; E01F 9/0188; A47B 65/10
USPC ..... 232/39; 248/298.1, 346.06, 346.07, 248/274.1, 288.11, 218.4, 149; 211/43, 50
See application file for complete search history.

(56) References Cited

U.S. PATENT DOCUMENTS

| | | | | | |
|---|---|---|---|---|---|
| 1,750,576 | A * | 3/1930 | Cubberley | A47B 65/00 | 211/11 |
| 2,552,915 | A * | 5/1951 | Zachrich | 248/154 | |
| 4,213,560 | A * | 7/1980 | Hall | 232/39 | |
| D262,336 | S * | 12/1981 | Barnstone | D19/34.1 | |
| 4,709,853 | A * | 12/1987 | Hahn | 232/39 | |
| 4,874,099 | A * | 10/1989 | Arnott | A47G 21/16 | 211/184 |
| 5,337,954 | A | 8/1994 | Kobilarcik et al. | | |
| 5,386,938 | A | 2/1995 | West | | |
| 5,509,603 | A | 4/1996 | Hering | | |
| 5,664,748 | A | 9/1997 | Speece | | |
| 5,711,433 | A * | 1/1998 | Smith | 211/71.01 | |
| 5,797,213 | A | 8/1998 | Frick | | |
| 5,906,080 | A * | 5/1999 | diGirolamo et al. | 52/243.1 | |
| 6,439,528 | B1 * | 8/2002 | Goto | F16M 11/00 | 211/43 |
| 6,543,680 | B1 | 4/2003 | McCormack | | |
| 6,644,609 | B1 * | 11/2003 | Scott | 248/243 | |
| 6,955,291 | B1 | 10/2005 | Knight | | |
| 7,172,163 | B1 | 2/2007 | Johnson | | |
| 7,185,803 | B1 * | 3/2007 | Lutzke | 232/39 | |
| 7,389,911 | B2 | 6/2008 | Ruocco | | |
| 7,448,531 | B1 | 11/2008 | Bolles | | |
| 7,451,912 | B1 * | 11/2008 | Taube, II | 232/29 | |
| 7,497,368 | B2 | 3/2009 | Lutzke | | |
| 8,087,627 | B2 | 1/2012 | Patterson et al. | | |
| 8,104,732 | B1 * | 1/2012 | Robinson et al. | 248/346.01 | |
| 8,322,598 | B1 | 12/2012 | Farentinos | | |
| 2002/0130171 | A1 | 9/2002 | Grell | | |
| 2005/0127259 | A1 | 6/2005 | Riker | | |
| 2006/0022028 | A1 | 2/2006 | Thomas | | |
| 2013/0001386 | A1 * | 1/2013 | Van Wingerden et al. | 248/219.2 | |

* cited by examiner

*Primary Examiner* — William Miller
(74) *Attorney, Agent, or Firm* — Pitts & Lake, P.C.

(57) ABSTRACT

An adjustable mounting bracket for mounting a mailbox, the mounting bracket including a first side section configured to contact one side of the mailbox and having one or more first anchoring portions extending inwardly from the first side section to contact a supporting body, and a second side section configured to contact another side of the mailbox and having one or more second anchoring portions extending inwardly from the second side section to contact the supporting body, wherein the first and second anchoring portions are configured to contact the supporting body without overlapping.

17 Claims, 6 Drawing Sheets

ADJUSTABLE MOUNTING BRACKET FOR MOUNTING A MAILBOX

CROSS-REFERENCE TO RELATED APPLICATIONS

This application is a continuation-in-part of U.S. Patent Application No. 61/838,929, filed on Jun. 25, 2013, the contents of which are incorporated by reference herein in its entirety.

FIELD OF INVENTION

The present general inventive concept relates generally to a mounting bracket for mounting a mailbox, and, more particularly, to a mounting bracket having an adjustable width to accommodate a variety of mailbox sizes.

BACKGROUND

The mounting of a mailbox can be an onerous task, due to the variety of sizes and styles of mailboxes, along with the variety and sized of support structures on which to mount the mailboxes, sometimes resulting in less than optimal pairings. This may be especially so when replacing a mailbox while maintaining the existing base, such as a post, or in the reverse situation of changing the post for an existing mailbox. Rather than having a limited choice of mailbox due to the size of the post on which the mailbox would be mounted, the mailbox installer may instead desire a bracket that will allow more choices of mailbox styles and sizes to be installed on the existing post. Thus, there is a desire for a "universal" bracket that would allow a large variety of mailboxes to be installed on a variety of support structures.

BRIEF SUMMARY

The present general inventive concept provides an adjustable bracket for mounting a mailbox, the bracket having separated sections which may be moved closer or further apart to receive different sized mailboxes or other such small structures.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by an adjustable mounting bracket for mounting a mailbox, the mounting bracket including a first side section configured to contact one side of the mailbox and having one or more first anchoring portions extending inwardly from the first side section to contact a supporting body, and a second side section configured to contact another side of the mailbox and having one or more second anchoring portions extending inwardly from the second side section to contact the supporting body, wherein the first and second anchoring portions are configured to contact the supporting body without overlapping.

The first and second anchoring portions may be configured to contact the supporting body in a substantially parallel pattern.

The first and second side sections may be respectively provided with one or more through holes to receive one or more coupling members to couple the first and second side sections to the mailbox.

The one or more through holes may be elongated grooves extending along the respective first and second side sections to receive the one or more coupling members at one or more points along the grooves.

The one or more through holes may be configured to be smaller than a circumference of a threaded pattern of a sheet metal screw.

The mounting bracket may further include one or more protrusions extending from one or more of the respective through holes to increase a width of the respective through holes.

The protrusions may extend inwardly from the first and/or second side sections.

The protrusions may extend outwardly from the first and/or second side sections.

The protrusions may extend both inwardly and outwardly from the first and/or second side sections.

The protrusions may extend continuously from the perimeter of the one or more respective through holes.

The protrusions may extend from one or more portions of the one or more respective through holes.

The first and second side sections may be configured to be thicker than a distance between threads of the sheet metal screw.

The first and second anchoring portions may be respectively provided with one or more through holes to receive one or more coupling members to couple the first and second anchoring portions to the supporting body.

The one or more through holes may be elongated grooves extending along the respective first and second anchoring portions to receive the one or more coupling members at one or more points along the grooves.

A desired width of the mounting bracket may be set by spacing the first and second side sections the desired width apart before coupling the first and/or second anchoring portions to the supporting body.

The first and second anchoring portions may be provided with respective corresponding indicia to be aligned to set one or more predetermined widths of the mounting bracket.

The first side section and first anchoring portions may have the same dimensions as the second side section and second anchoring portions.

The first and second anchoring portions may extend respectively from the first and second side sections substantially perpendicularly.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
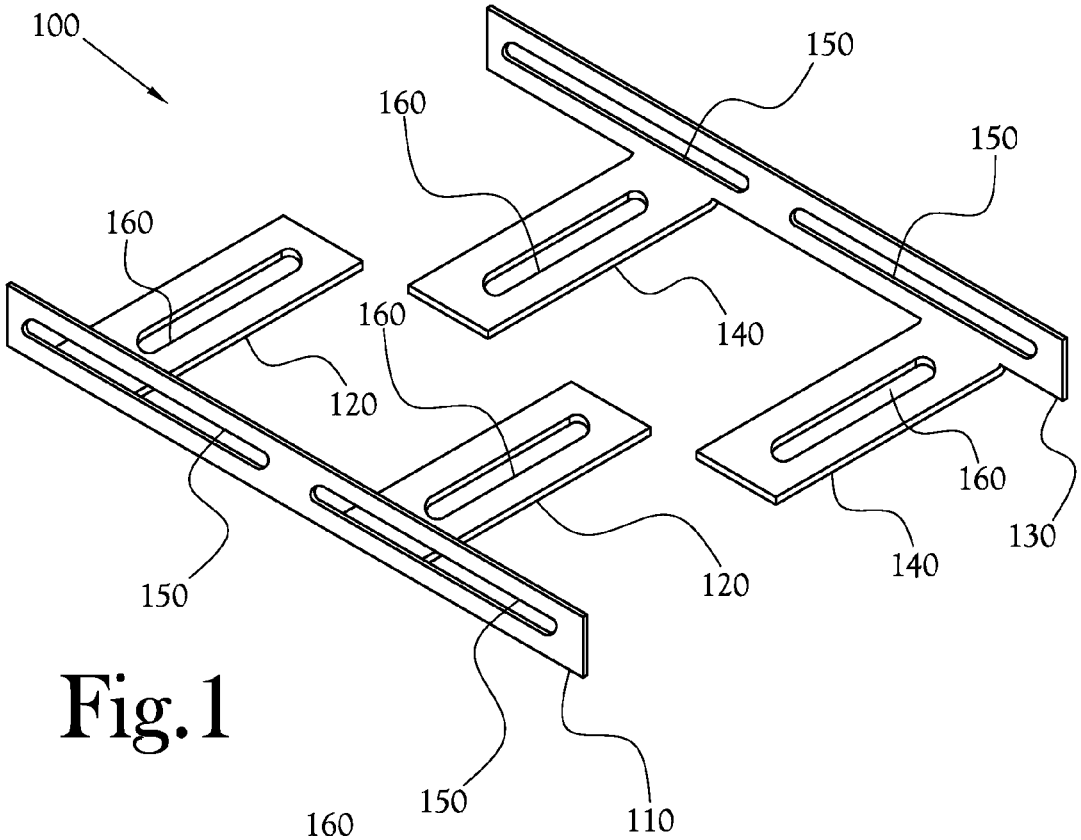
FIGS. 1-2 illustrate an adjustable mounting bracket according to an example embodiment of the present general inventive concept.

Reference will now be made to various example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The described progression of processing operations described are merely examples, however, and the sequence of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various example embodiments of the present general inventive concept, as described herein, provide an adjustable mounting bracket for mounting a mailbox wherein the mounting bracket includes two sections that may be moved closer together or further apart to accommodate different styles and/or widths of mailboxes to be installed thereon. Thus, the mounting bracket may be used with a variety of different mailboxes, and may be fixed to a variety of different bases upon which a user wishes to mount the mailbox.

While the example embodiments of the present general inventive concept discussed herein generally describe the mounting of mailboxes, it is noted that the adjustable mounting bracket may be used to mount a variety of small structures, such as birdhouses, etc., onto a supporting body, and therefore the use of the adjustable mounting bracket is not limited to mailboxes.

In various example embodiments of the present general inventive concept, the mounting bracket may include a first side section configured to contact one side of the mailbox and having one or more first anchoring portions extending inwardly from the first side section to contact a supporting body, and a second side section configured to contact another side of the mailbox and having one or more second anchoring portions extending inwardly from the second side section to contact the supporting body, wherein the first and second anchoring portions are configured to contact the supporting body without overlapping. The desired width of the mounting bracket may be set by spacing the first and second side sections the desired width apart before coupling the first and/or second anchoring portions to the supporting body.

Figure 2:
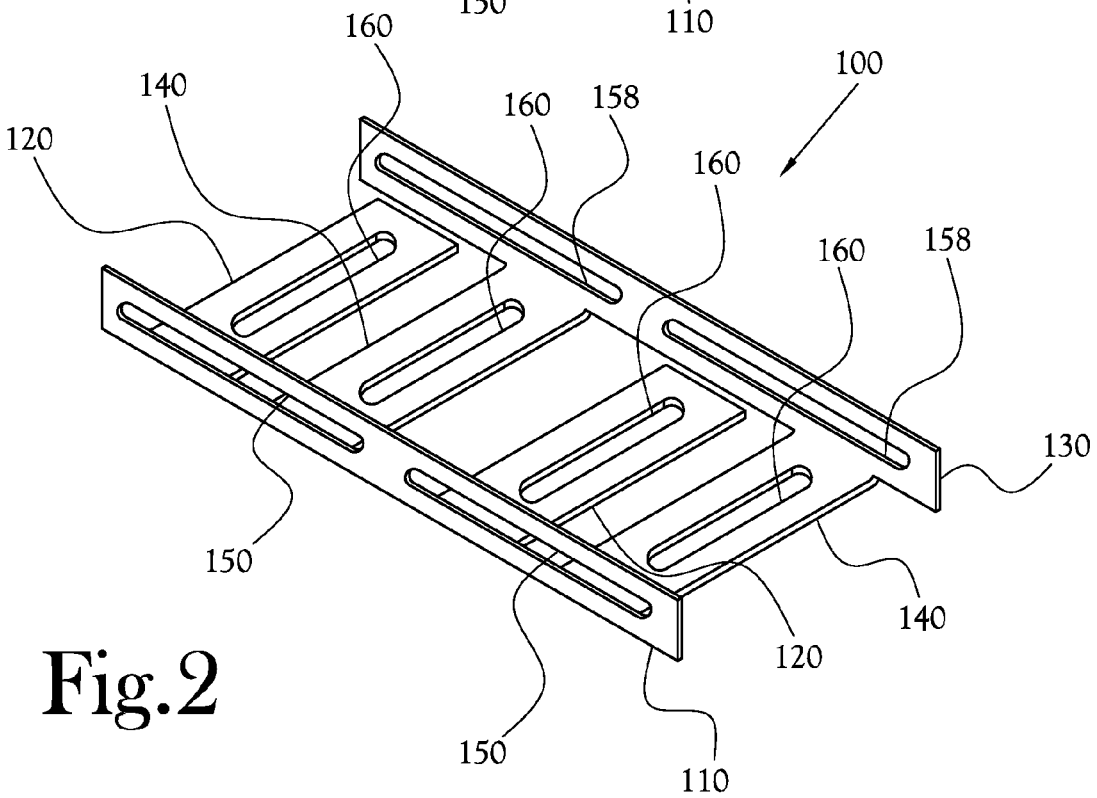

FIGS. 1-2 illustrate an adjustable mounting bracket according to an example embodiment of the present general inventive concept. The mounting bracket 100 of FIGS. 1-2 includes a first side section 110 to contact one side of the mailbox which will be attached to the mounting bracket 100, and has two first anchoring portions 120 extending inwardly from the first side section 110 to be attached to a supporting body, such as a post, cantilever, etc. Although the embodiment illustrated in these drawings includes two of the anchoring portions 120, more or less anchoring portions may be provided. A second side section 130 is also provided to contact another side of the mailbox, and has two second anchoring portions 140 extending inwardly from the second side section 130. The first and second anchoring portions 120,140 will be located under the mailbox after the mailbox is attached to the mounting bracket 100.

The configuration of the first and second side sections 110,130 determines the width of the mounting bracket. In other words, the first and second side sections 110,130 may be placed at various distances from one another to customize the width of the mounting bracket 100 to accommodate different sizes of mailboxes. As illustrated in FIG. 2, the first and second anchoring portions 120,140 may be configured so as to extend substantially perpendicularly from the respective first and second side sections 110,130, and may be arranged in a substantially perpendicular fashion after being attached to the supporting body. However, various other example embodiments may provide anchoring portions in other configurations/arrangements.

As illustrated in FIGS. 1-2, the first and second side sections 110,130 are each provided with one or more through holes 150 to receive one or more coupling members to couple the first and second side sections 110,130 to the sides of the mailbox. The coupling members may be, for example, screws, or other similar attachment bodies. As illustrated in the example embodiments of FIGS. 1-2, the through holes 150 may be provided as one or more elongated grooves extending along the first and second side sections 110,130, such that the coupling members may be applied at various locations as desired or needed for the mailbox being mounted. For example, some mailboxes may come with pre-formed holes for attachment screws, and the groove-shaped through holes will allow a greater range of placement for the mailbox relative to the mounting bracket 100. In other various example embodiments, the one or more through holes 150 may be provided to receive single coupling members at a fixed point.

Similarly, the first and second anchoring portions 120,140 may be provided with one or more through holes 160 to receive a coupling member to couple the first and second anchoring portions 120,140 to the supporting body upon which the mounting bracket 100 is fixed. Like the through holes 150, the through holes 160 may be configured as elongated grooves extending along the respective first and second anchoring portions 120,140 to allow greater freedom in the placement of the coupling members received therein.

According to various example embodiments of the present general inventive concept, the through holes 150 may be configured to be smaller in at least one radial direction than a circumference of a threaded pattern of a sheet metal screw, so that the threaded pattern interacts with the edge of the through holes 150. In other words, the through holes 150 may be sufficiently small that the threaded pattern of the sheet metal screw will form a thread groove in the first and second side sections 110,130 themselves between the inner and outer edges of the through holes 150. Similarly, in various example embodiments the first and second side sections 110,130 may be configured to be thicker than a distance between the threads of the sheet metal screw, to allow the sheet metal screw to form such a thread groove in the first and second side sections 110,130 to enhance the securing action of the sheet metal screw when attaching the mailbox to the mounting bracket 100.

Figure 3:
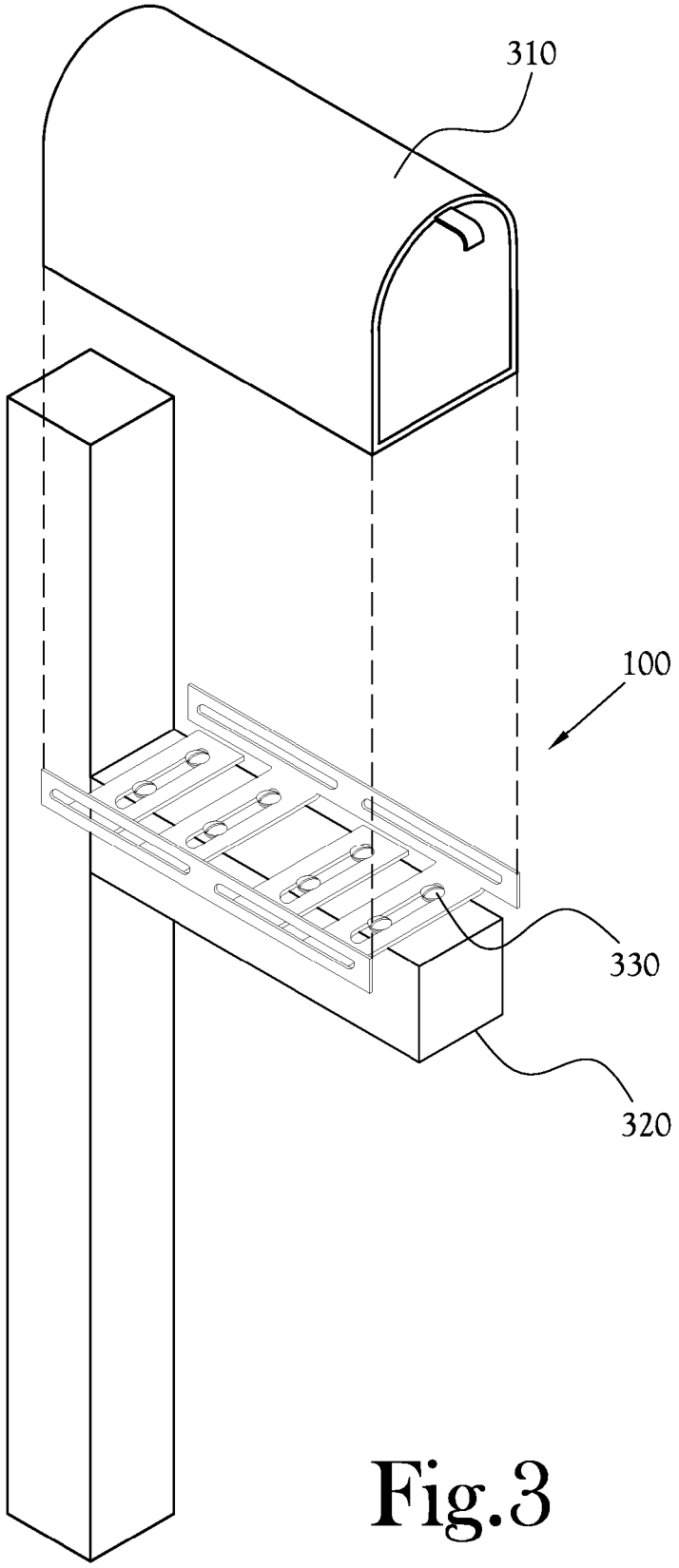
FIG. 3 illustrates an example installation of the mounting bracket illustrated in FIGS. 1-2 onto a supporting body.

FIG. 3 illustrates an example installation of the mounting bracket illustrated in FIGS. 1-2 onto a supporting body. As illustrated in FIG. 3, before attaching the mailbox 310 to the mounting bracket 100, the mounting bracket 100 may be attached to the supporting body 320, which in this example is a cantilever attached to a mailbox post. The mounting bracket 100 may be attached to the supporting body by one or more wood screws 330 that are screwed through the through holes 160 of the respective first and second anchoring portions 120,140. The illustrated wood screws 330 are merely one example of coupling members that may be used to attach the mounting bracket 100 to the supporting body 320, and several other coupling members or combinations of different types of coupling members, including adhesives, may be employed. The first and second side sections 110,130 are placed according to the desired width of the mounting bracket 100 before anchoring the first and second anchoring portions 120,140 to the supporting body 320.

Figure 4:
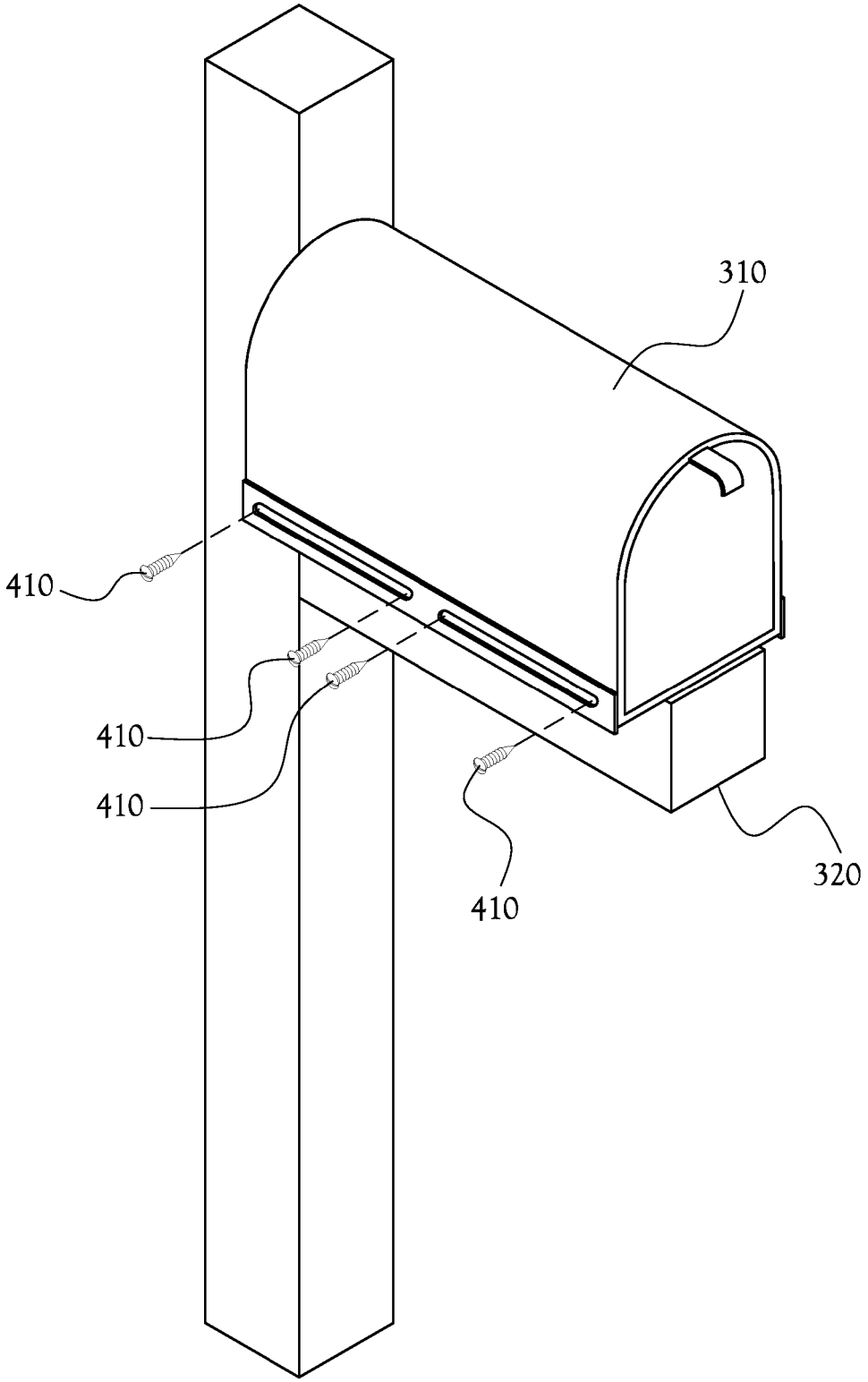
FIG. 4 illustrates the mounting of a mailbox onto the installed mounting bracket illustrated in FIG. 3.

FIG. 4 illustrates the mounting of a mailbox onto the installed mounting bracket illustrated in FIG. 3. After the mounting bracket 100 is attached to the supporting body 320, the mailbox 310 may be attached to the mounting bracket by one or more sheet metal screws 410 that are screwed through the through holes 150 of the respective first and second side sections 110,130. The illustrated sheet metal screws 410 are merely one example of coupling members that may be used to attach the mailbox 310 to the respective first and second side sections 110,130 of the mounting bracket 100, and several other coupling members or combinations of different types of coupling members, including adhesives, may be employed.

Figure 5:
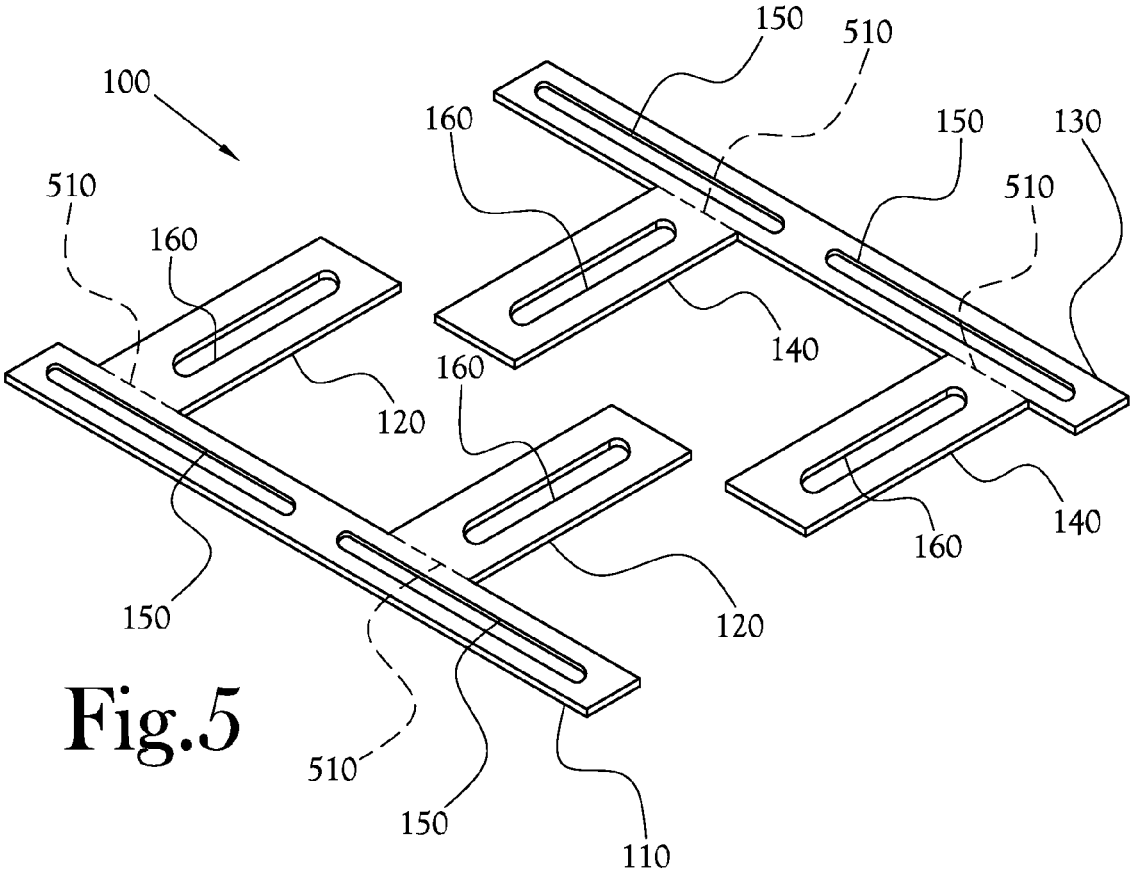
FIG. 5 illustrates a partially formed mounting bracket according to an embodiment of the present general inventive concept.

The mounting bracket of the present general inventive concept may be formed in a variety of different ways. FIG. 5 illustrates a partially formed mounting bracket according to an embodiment of the present general inventive concept, in which two halves of the mounting bracket 100, each half including a respective side section and anchoring portion, are formed from a single sheet of material, such as a sheet of metal. The through holes 150,160 may also be formed during the same process. In the example embodiment illustrated in FIG. 5, the two halves may be punched, cut, etc., from a sheet of metal, and then the respective side sections 110,130 and/or anchoring portions 120,140 are bent at a bend line 510 until the anchoring portions 120,140 are substantially perpendicular to the attached side sections 110,130.

According to various example embodiments, the first and second side sections 110,130 may have substantially identical dimensions to simplify the production of the mounting bracket 100. In other words, the first side section 110 and first anchoring portion 120 will have the same shape as the second side section 130 and second anchoring portion 140, with the respective anchoring portions being configured so as not to overlap when the two halve are combined to form the mounting bracket 100.

Figure 6:
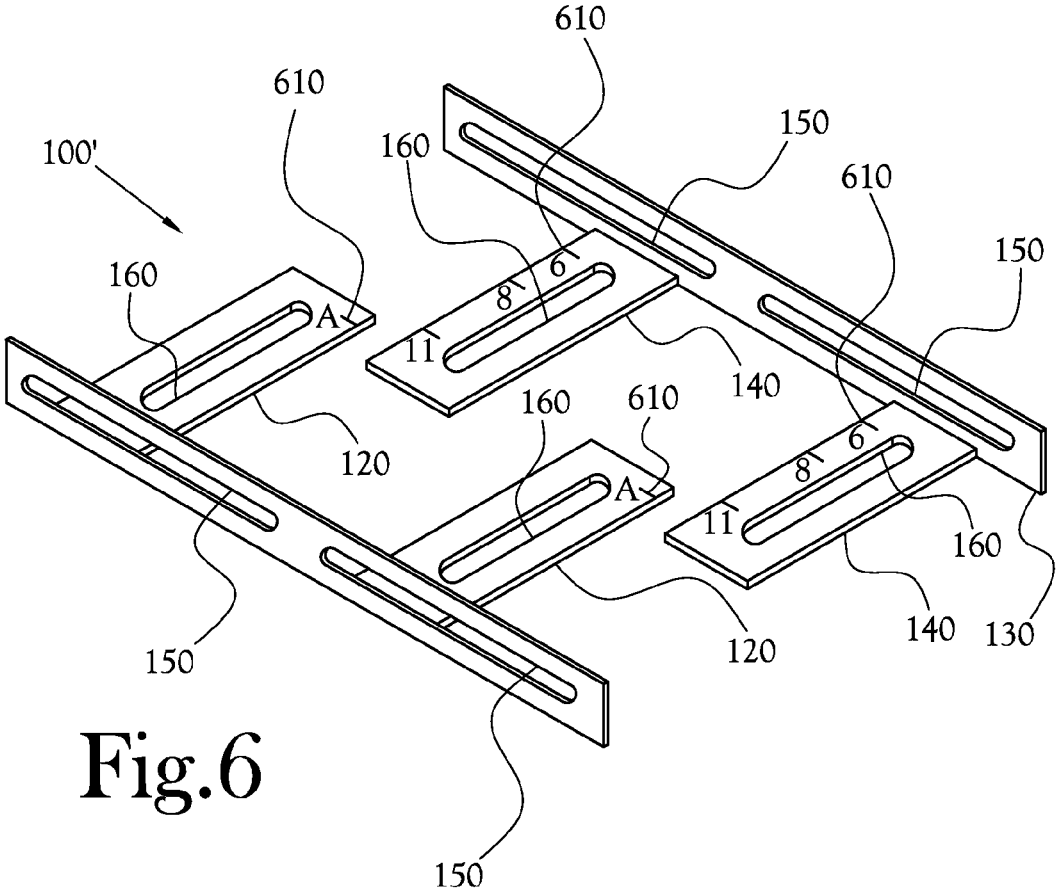
FIGS. 6-7 illustrate an adjustable mounting bracket according to another example embodiment of the present general inventive concept.
Figure 7:
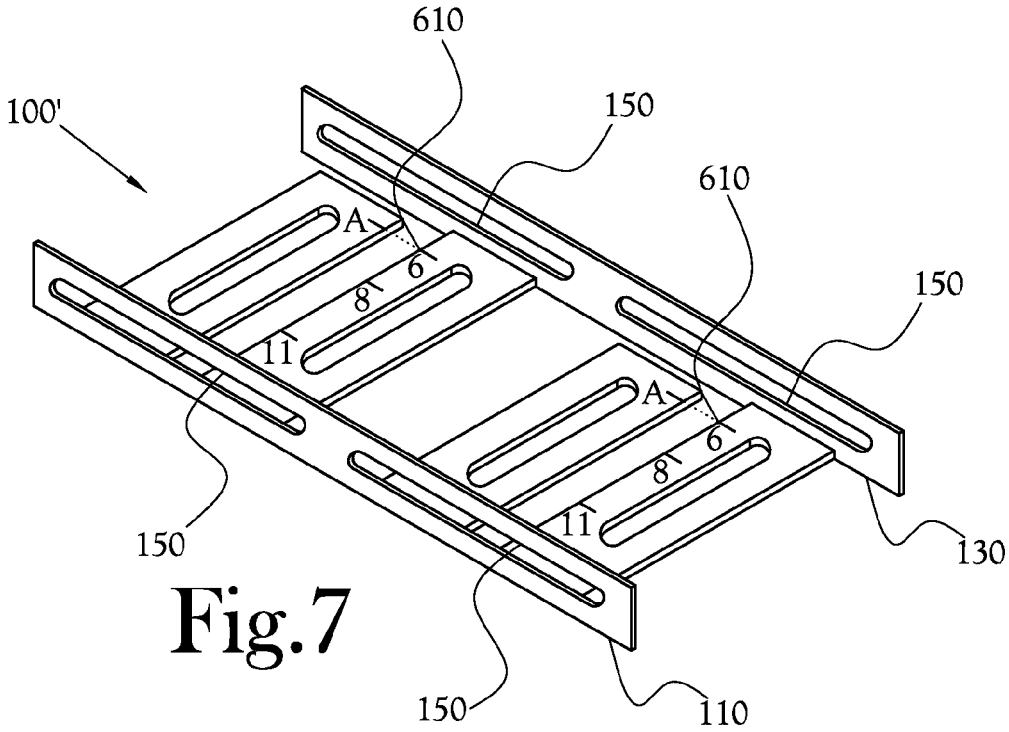

FIGS. 6-7 illustrate an adjustable mounting bracket according to another example embodiment of the present general inventive concept. The mounting bracket 100' of the example embodiment illustrated in FIGS. 6-7 includes first and second anchoring portions 120,140 that are not formed of a continuous material with the first and second side sections 110,130, but rather are attached to the first and second side sections 110,130 by any of a number of attachment methods, such as welding and the like.

The example embodiment illustrated in FIGS. 6-7 also includes corresponding indicia 610 which may be included on the first and second anchoring portions 120,140 to indicate predetermined widths available to the installer of the mounting bracket 100'. The corresponding indicia 610 may be formed according to standard mailbox widths, such as 6", 8", and 11". In more detail, as illustrated in FIGS. 6-7, the second anchoring portion 140 may be provided with markings of 6, 8, and 11, with corresponding line marks, that may be aligned with a line mark associated with the letter "A" (for alignment) on the first anchoring portion 120 in order to easily configure these predetermined widths when installing the mounting bracket 100'. The corresponding indicia 610 illustrated in FIGS. 6-7 are merely examples of possible indicia, and various other example embodiments may employ different sizes or markings. Additionally, according to various example embodiments, the corresponding indicia 610 may be provided in a variety of ways, such as being engraved on the respective anchoring portions, printed in paint or ink, and so on.

Figure 8:
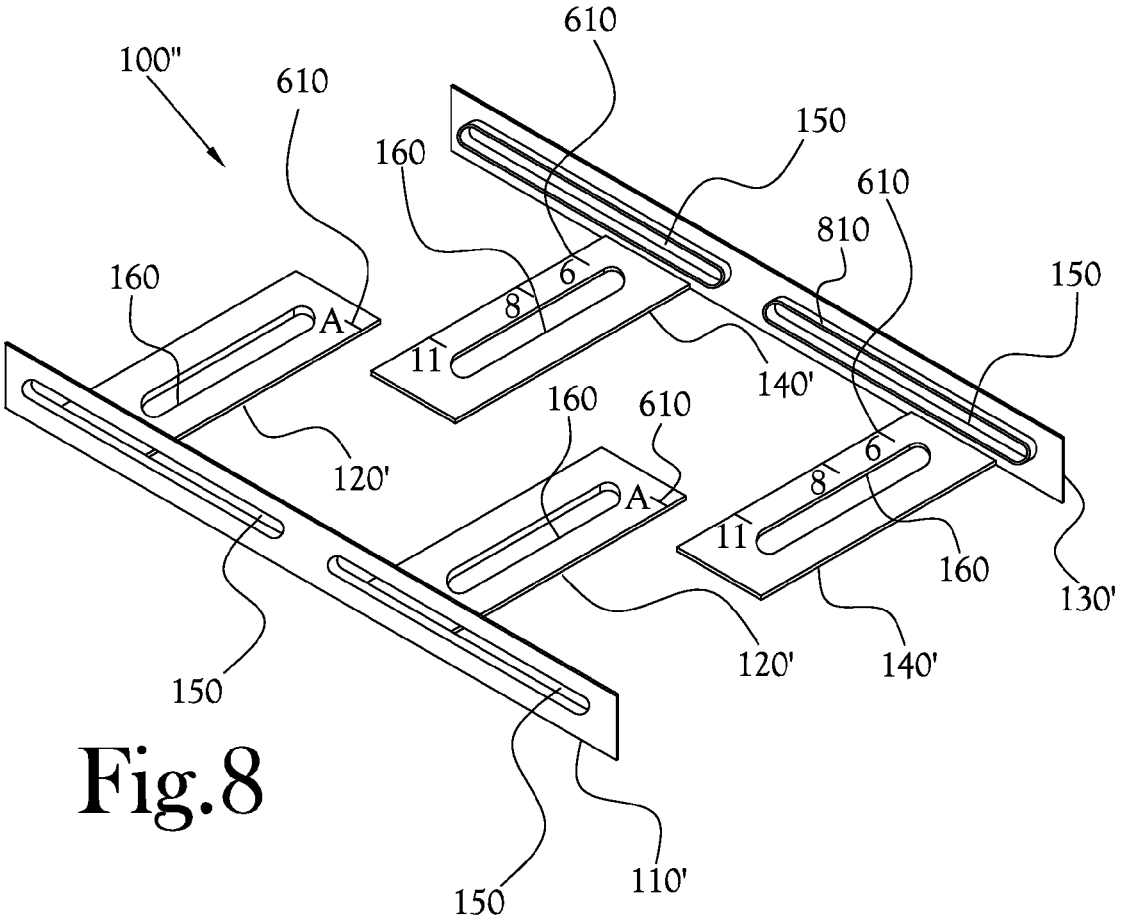
FIG. 8 illustrates an adjustable mounting bracket according to yet another example embodiment of the present general inventive concept.

FIG. 8 illustrates an adjustable mounting bracket according to yet another example embodiment of the present general inventive concept. In the example embodiment illustrated in FIG. 8, the first and second side sections 110',130' are provided with protrusions 810 that extend respectively from each of the through holes 150 to effectively make the through holes 150 wider to accommodate screws with a larger area between threads than screws that may be used in the example embodiments previously described. Alternatively, the protrusions 810 may be provided to accommodate the same screws that may be used in the previously described example embodiment, but in an example embodiment in which the first and second side sections 110',130' are configured to be thinner than those depicted in the previously described example embodiments. As depicted in FIG. 8, the first and second side sections 110',130' are thinner than the first and side sections 110,130 illustrated in FIGS. 1-7. According to various example embodiments of the present general inventive concept, the anchoring portions 120',140' may also vary in width according the desired configuration. While the protrusions 810 illustrated in FIG. 8 are illustrated as extending inwardly from the first and second side sections 110',130', it is understood that the protrusions may be configured to extend outwardly from the first and second side sections 110',130' in other various example embodiments, or may extend both inwardly and outwardly. Further, while the protrusions 810 illustrated in FIG. 8 are configured to extend from the entire perimeter of the through holes 150, in various other example embodiments the protrusions may be configured to be non-continuous and extend from only portions of the perimeter of the through holes 150, such as, for example, only from a top and bottom portion of the through holes 150. Additionally, various example embodiments of the present general inventive concept may include protrusions 810 of varying widths, and may include different widths extending from the same side sections. According to various example embodiments of the present general inventive concept, the protrusions 810 may only be configured to extend from less than all of the through holes 150, or may extend inwardly from one or more through holes 150 while extending outwardly from one or more other through holes 150, etc. The protrusions 810 may be formed continuously with the first and second side sections 110',130', or may be attached to the first and second side sections 110',130' by any of a number of attachment methods, such as welding and the like.

It is noted that while particular different features are described and illustrated in regard to FIGS. 6-8, any or all of the example features illustrated in FIGS. 6-8 may be included in the previously described example embodiments of the present general inventive concept.

According to various embodiments of the present general inventive concept, an adjustable mounting bracket for mounting a mailbox is provided, the mounting bracket including a first side section configured to contact one side of the mailbox and having one or more first anchoring portions extending inwardly from the first side section to contact a supporting body, and a second side section configured to contact another side of the mailbox and having one or more second anchoring portions extending inwardly from the second side section to contact the supporting body, wherein the first and second anchoring portions are configured to contact the supporting body without overlapping. The desired width of the mounting bracket may be set by spacing the first and second side sections the desired width apart before coupling the first and/or second anchoring portions to the supporting body.

It is noted that the simplified diagrams and drawings do not illustrate all the various connections and assemblies of the various components, however, those skilled in the art will understand how to implement such connections and assemblies, based on the illustrated components, figures, and descriptions provided herein, using sound engineering judgment.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. An adjustable mailbox mounting bracket for mounting a mailbox, the mounting bracket comprising:

a first side section configured to contact one side of the mailbox and having one or more first anchoring portions extending inwardly from the first side section to contact a supporting body; and a second side section configured to contact another side of the mailbox and having one or more second anchoring portions extending inwardly from the second side section to contact the supporting body;

wherein the first and second anchoring portions are configured to extend in a staggered arrangement respectively toward portions of the second and first side sections from which other anchoring portions do not extend, so as to contact the supporting body without overlapping and without contact therebetween; and wherein the first and second side sections are respectively provided with one or more through holes receiving one or more coupling members to fixedly couple the first and second side sections to the mailbox.

2. The mailbox mounting bracket of claim 1, wherein the first and second anchoring portions are configured to contact the supporting body in a substantially parallel pattern.

3. The mailbox mounting bracket of claim 1, wherein the one or more through holes are elongated grooves extending along the respective first and second side sections to receive the one or more coupling members at one or more points along the grooves.

4. The mailbox mounting bracket of claim 1, wherein the one or more coupling members comprise a sheet metal screw, and wherein the one or more through holes are configured to be smaller than a circumference of a threaded pattern of the sheet metal screw.

5. The mailbox mounting bracket of claim 4, wherein the first and second side sections are configured to be thicker than a distance between threads of the sheet metal screw.

6. The mailbox mounting bracket of claim 1, further comprising one or more protrusions extending from one or more of the respective through holes to increase a width of the respective through holes.

7. The mailbox mounting bracket of claim 6, wherein the protrusions extend inwardly from the first and/or second side sections.

8. The mailbox mounting bracket of claim 6, wherein the protrusions extend outwardly from the first and/or second side sections.

9. The mailbox mounting bracket of claim 6, wherein the protrusions extend both inwardly and outwardly from the first and/or second side sections.

10. The mailbox mounting bracket of claim 6, wherein the protrusions extend continuously from the perimeter of the one or more respective through holes.

11. The mailbox mounting bracket of claim 6, wherein the protrusions extend from one or more portions of the one or more respective through holes.

12. The mailbox mounting bracket of claim 1, wherein the first and second anchoring portions are respectively provided with one or more through holes to receive one or more coupling members to couple the first and second anchoring portions to the supporting body.

13. The mailbox mounting bracket of claim 12, wherein the one or more through holes are elongated grooves extending along the respective first and second anchoring portions to receive the one or more coupling members at one or more points along the grooves.

14. The mailbox mounting bracket of claim 1, wherein a desired width of the mounting bracket is set by spacing the first and second side sections the desired width apart before coupling the first and/or second anchoring portions to the supporting body.

15. The mailbox mounting bracket of claim 1, wherein the first and second anchoring portions are provided with respective corresponding indicia to be aligned to set one or more predetermined widths of the mounting bracket.

16. The mailbox mounting bracket of claim 1, wherein the first side section and first anchoring portions have the same dimensions as the second side section and second anchoring portions.

17. The mailbox mounting bracket of claim 1, wherein the first and second anchoring portions extend respectively from the first and second side sections substantially perpendicularly.

* * * * *